US005125248A

United States Patent [19]

Ling

[11] Patent Number: 5,125,248

[45] Date of Patent: Jun. 30, 1992

[54] COMBINATION PADLOCK

[76] Inventor: Chong-Kuan Ling, P.O. Box 53-58, Taipei, Taiwan

[21] Appl. No.: 741,312

[22] Filed: Aug. 7, 1991

[51] Int. Cl.[5] ..... E05B 37/06

[52] U.S. Cl. ..... 70/25; 70/312; 70/323

[58] Field of Search ..... 70/22-26, 70/312-318, 323

[56] References Cited

U.S. PATENT DOCUMENTS

| | | | |
|---|---|---|---|
| 718,146 | 1/1903 | Nielander | 70/25 |
| 1,737,477 | 11/1929 | Schmidt | 70/25 |
| 1,940,789 | 12/1933 | Diaz | 70/25 |
| 1,942,454 | 1/1934 | Samburg | 70/25 |
| 3,720,082 | 3/1973 | Feinberg et al. | 70/25 |
| 4,048,821 | 9/1977 | Bako et al. | 70/25 |
| 4,733,548 | 3/1988 | Ling | 70/25 |
| 4,742,700 | 5/1988 | Ling | 70/323 X |
| 4,860,561 | 8/1989 | Hwang | 70/23 X |
| 4,970,881 | 11/1990 | Hsaio | 70/25 |
| 5,042,277 | 8/1991 | Jenn-Rong | 70/23 X |

FOREIGN PATENT DOCUMENTS

| | | | |
|---|---|---|---|
| 969865 | 12/1950 | France | 70/25 |

*Primary Examiner*—Renee S. Luebke
*Assistant Examiner*—Suzanne L. Dino

[57] ABSTRACT

A combination padlock includes a plurality of dials longitudinally rotatably mounted in a central portion of a casing having two opposite secant peripheries of each dial protruding frontwardly and rearwardly from the casing for a firm rotating dialing operation by a user's two fingers disposed on a front and a rear side of the casing for ensuring a precise lock opening or closing operation and for preventing an unexpected impact or damage of the lock caused by an external force or object.

9 Claims, 5 Drawing Sheets 2
1e
212
131
14
22
210
21
13
12
132
1
40
54
5
55
211
162
541
163
551
16
52
41
521
3
43
341
351
15
42
34
32
151
53
3'
3
441
44
16
161
164
15
43
53
51
35
16
2'
164
2
151
351
41
161
32
42
4
15
161
12
18
161
44
451
10
53
1f
44
164
45
16

151
41
1b
31
3
5
15
341
53
17
12
1c
1
34
351
42
1d
35
11
1a
44
15
341
32
51
171
10
41
4
151
43
17

COMBINATION PADLOCK

BACKGROUND OF THE INVENTION

A conventional combination padlock as shown in FIG. 7 includes a plurality of dials rotatably mounted in a side portion of a lock casing, which however may have the following drawbacks:

1. The dials are formed on a side corner of the casing, vulnerable to be easily impacted or damaged by an external force or object.

2. A lock user may rotate the dials for opening or closing the padlock by using his or her single finger, rather than two figures, thereby easily slipping the dials to influence a precise dialing operation.

3. Once the lock is unlocked at an opening combination, the dials provided at a side corner of the lock casing may easily be accidentally touched or rotated by an external object or force to cause an unexpected locking of the padlock.

The present inventor has found the drawbacks of a conventional combination padlock and invented the present invention having centrally operating dials.

SUMMARY OF THE INVENTION

The object of the present invention is to provide a combination padlock including a plurality of dials longitudinally rotatably mounted in a central portion of a casing having two opposite secant peripheries of each dial protruding frontwardly and rearwardly from the casing for a firm rotating dialing operation by a user's two fingers disposed on a front and a rear side of the casing for ensuring a precise lock opening or closing operation and for preventing an unexpected impact or damage of the lock caused by an external force or object.

DETAILED DESCRIPTION

Figure 1A:
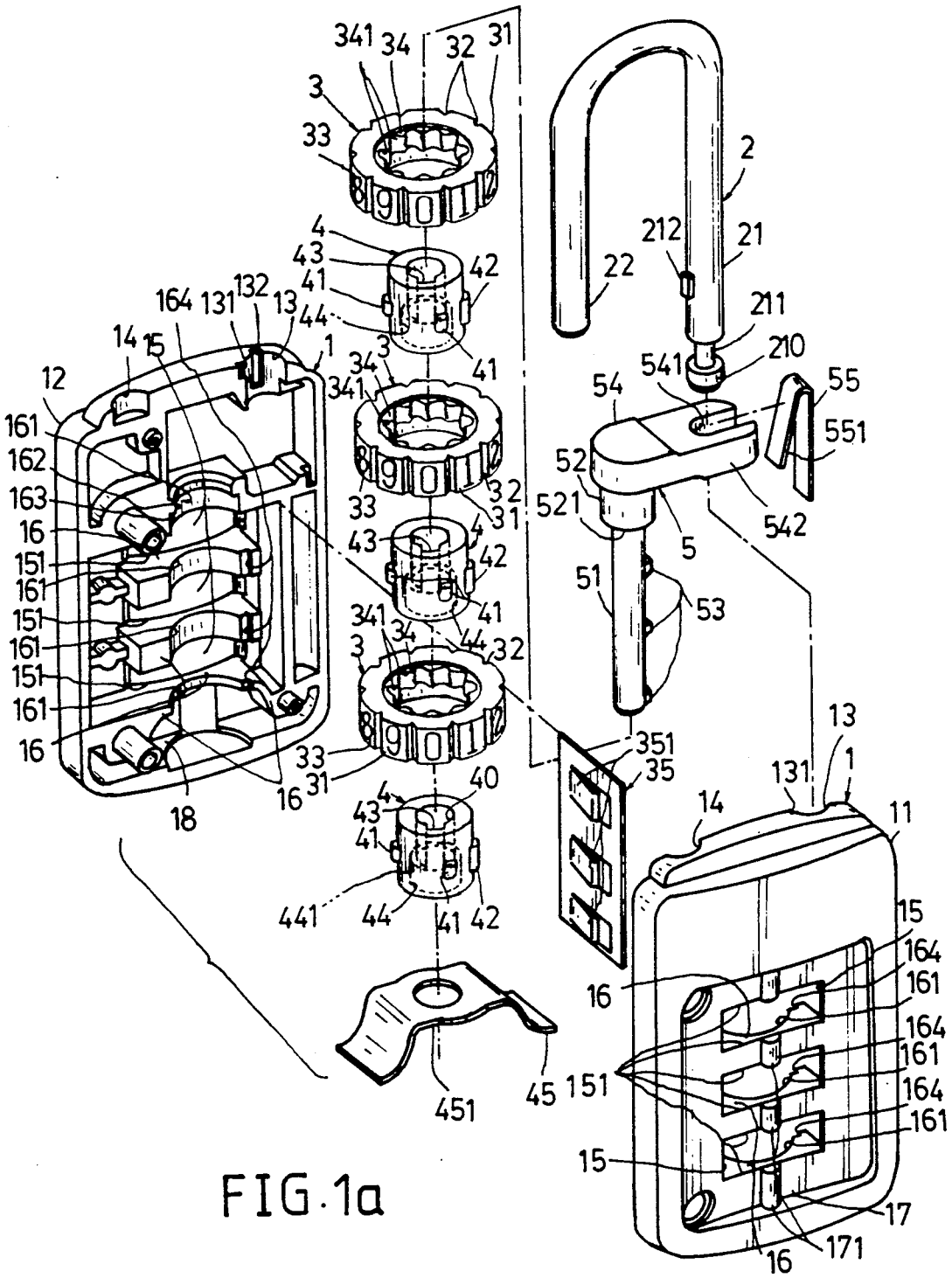
FIG. 1*a* is an exploded view showing all elements in construction of the present invention.

As shown in FIGS. 1–6, the present invention comprises: a casing 1, a shackle 2 generally U shaped, a plurality of dials 3, a plurality of sleeves 4, and a locking bolt means 5.

The casing 1 is comprised of two half-shell portions 11, 12 which are integrally combined to form the casing 1 for encasing the elements of the present invention in the casing 1, each half-shell portion 11 or 12 defining a wide-surface side portion on a front or rear side thereof.

Each half-shell portion 11 or 12 includes a plurality of rectangular windows 15 formed in each half-shell portion for protruding each dial 3 either frontwardly or rearwardly, and a plurality of half bush extensions 16 protruding inwardly from each half-shell portion. Each half bush extension 16 is juxtapositional to each window 15. Every two half bush extensions 16 combinably define a sleeve bush 161 in the two corresponding half bush extensions 16 for rotatably mounting each sleeve 4 therein.

A shallow arcuate recess 17 is formed in an outer surface of each half-shell portion 11 or 12 for protruding each dial 3, having a marking extension 171 longitudinally formed in a central portion 151 of the half-shell portion 11 or 12 for aligning or indicating a correct opening combination of the dials 3.

An uppermost bush extension 16 is formed with a bush shoulder portion 163 for limiting an uppermost sleeve 4, and an upper bolt hole 162 for passing a locking bolt 51 therethrough.

The casing 1 includes a shackle hole 13 formed in a first or right side portion on an upper portion 1*e* of the casing 1 for passing a long leg member 21 through the shackle hole 13, and a shackle socket 14 formed in a second or left side portion on the upper portion 1*e* of the casing 1 for receiving a short leg member 22 of the shackle 2.

The long leg member 21 of the shackle 2 is formed with a neck portion 211 annularly recessed from a cross section of a lower portion of the long leg member 21, a shackle head portion 210 formed on a lowest end portion of the long leg member 21 adjacent to the neck portion 211, and a shackle projection 212 longitudinally formed in the long leg member 21 engageable with a first projection socket 131 recessed in the upper portion 1*e* of the casing 1 communicated with the shackle hole 13 when the short leg member 22 is locked in the shackle socket 14, and also rotatably engageable with a second projection socket 132 recessed in the upper portion 1*e* of the casing 1 deviated from the first projection socket 131.

A plurality of positioning slots 164 are longitudinally projectively formed in the plurality of sleeve bushes 161 formed in the casing 1.

Each dial 3 is rotatably secured in the casing 1 along a longitudinal axis 10 formed in a center portion of the casing 1 and transversely protruding frontwardly and rearwardly through two corresponding rectangular windows 15 formed on a front side portion 1*a* and a rear side portion 1*b* of the casing 1 and includes an outer ring 31 having a plurality of numerals 33 such as: 0, 1, 2–9 annularly formed in the outer ring 31 with every two neighbouring numerals 33 separated by a longitudinal groove 32 notched in the outer ring 31, an inner ring 34 formed on an upper portion of the dial inside the outer ring 31 having a plurality of inner teeth 341 annularly formed in the inner ring 34, and a dial-sensing spring plate 35 retained in the casing 1 having a plurality of spring pawls 351 longitudinally formed in the dial-sensing spring plate 35 for clickingly engaging the grooves 32 of the dial 3.

Each sleeve 4 formed as a cylindrical collar rotatably engageable with each sleeve bush 161 formed in said casing 1 includes: a central bolt hole 40 formed through the sleeve 4, a plurality of outer teeth 41 circumferentially formed on an outer cylindrical surface of the sleeve 4 and engageable with the inner teeth 341 of the dials 3, a positioning tooth 42 formed on the outer cylindrical surface of the sleeve 4 engageable with the inner teeth 341 of the dial 3 and slidably engageable with the positioning slot 164 formed in the casing 1, an opening slot 43 longitudinally recessed in the central bolt hole 40, and a lower enlarged hole 44 diverging downwardly from the central bolt hole 40 to form a lower shoulder portion 441 between the bolt hole 40 and the enlarged hole 44.

A sleeve retaining spring 45 formed near a bottom portion 1*f* of the casing 1 includes an upper retaining surface 451 for normally urging the sleeves 4 upwardly to be limited by the bush shoulder portion 163 for engaging each sleeve 4 with each dial 3.

Figures 1, 2:
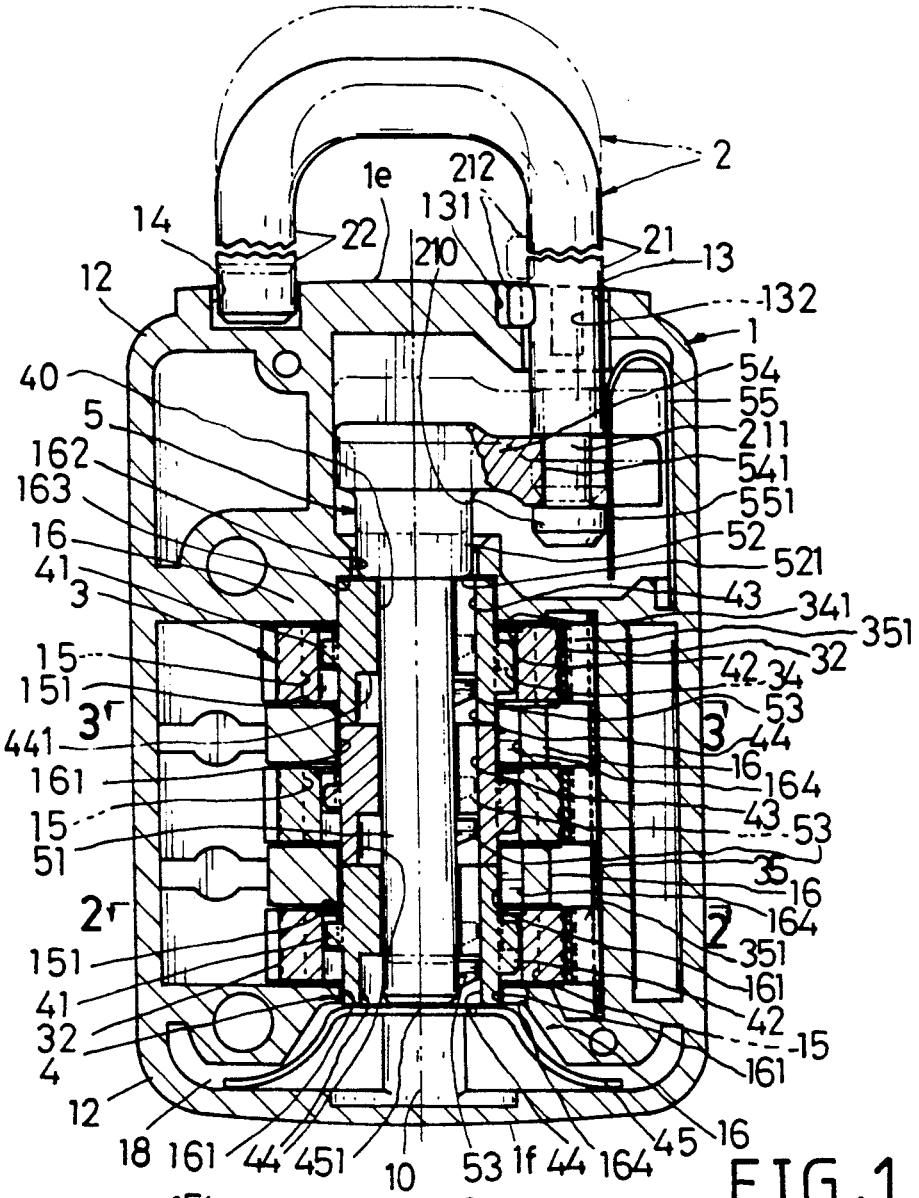
FIG. 1 is a sectional drawing of the present invention when unlocked.
FIG. 2 is a cross sectional drawing of the present invention when viewed from 2—2 direction of FIG. 1.
Figure 3:
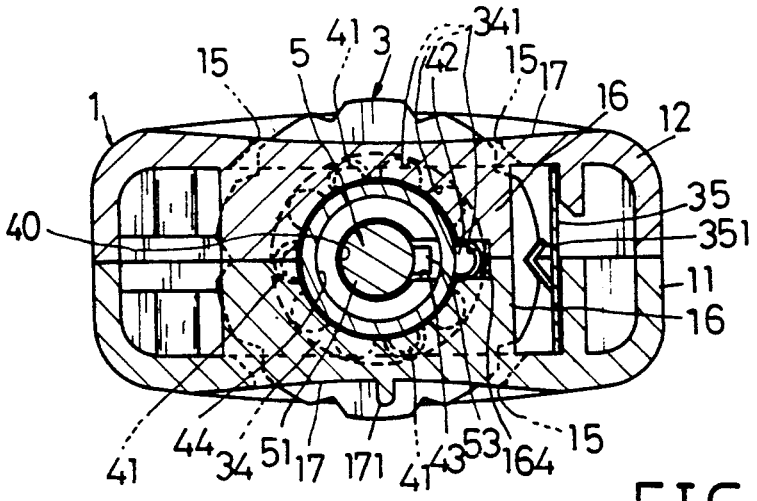
FIG. 3 is a cross sectional drawing of the present invention when viewed from 3—3 direction of FIG. 1.

As shown in FIG. 2, each dial 3 is protruded transversely from a wide-surface front side 1*a* and a wide surface rear side 1*b* of the casing 1, rather than a narrow right side 1*c* or left side 1*d* for convenient dialing operation by a user's two fingers disposed on two sides 1*a*, 1*b* of the casing, thereby opening or closing the lock precisely and preventing an unexpected impact or damage on the dials 3 for protecting the dials 3. The shallow recess 17 will help reveal the secant dial periphery on each side of the dial 3 for a smooth dialing operation therefore.

The locking bolt means 5 includes: a locking bolt 51 generally cylindrical shaped engageable with the central bolt hole 40 in each sleeve 4, a head portion 52 formed on an upper portion of the locking bolt 51 secured with a connecting lever 54 rotatably coupled with the long leg member 21 of the shackle 2, a plurality of bolt projections 53 longitudinally formed on the locking bolt 51 each bolt projection 53 normally retained under the lower shoulder portion 441 of each sleeve 4 when the padlock is locked and operatively passing through each opening slot 43 formed in each sleeve 4 as shown in FIG. 2 when the padlock is unlocked and a shackle retaining spring 55 retained in the casing 1 normally urging the long leg member 21 of the shackle 2 for coupling the connecting lever 54 of the locking bolt means 5.

The connecting lever 54 is protruded sidewardly to form a bifurcated shackle retainer 542 defining a notch 541 recessed in the shackle retainer 542 for rotatably engaging the shackle head portion 210 with the shackle retainer 542 and engaging the neck portion 211 of the shackle 2 with the notch 541 of the connecting lever 54. The shackle head portion 210 is resiliently urged by a free spring end 551 of the shackle retaining spring 55 for a stable coupling of the shackle 2 with the locking bolt means 5.

Figure 5:
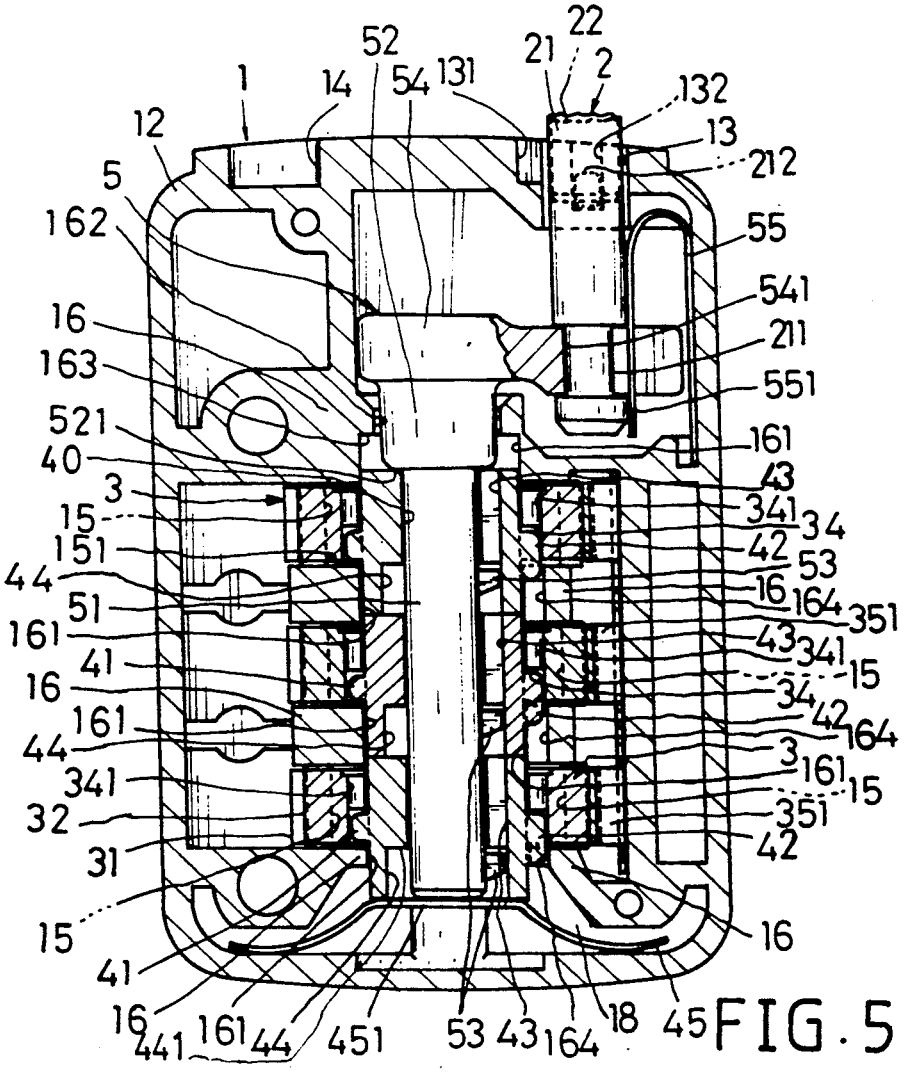
FIG. 5 is an illustration showing a change of the combination of the present invention.
Figure 4:
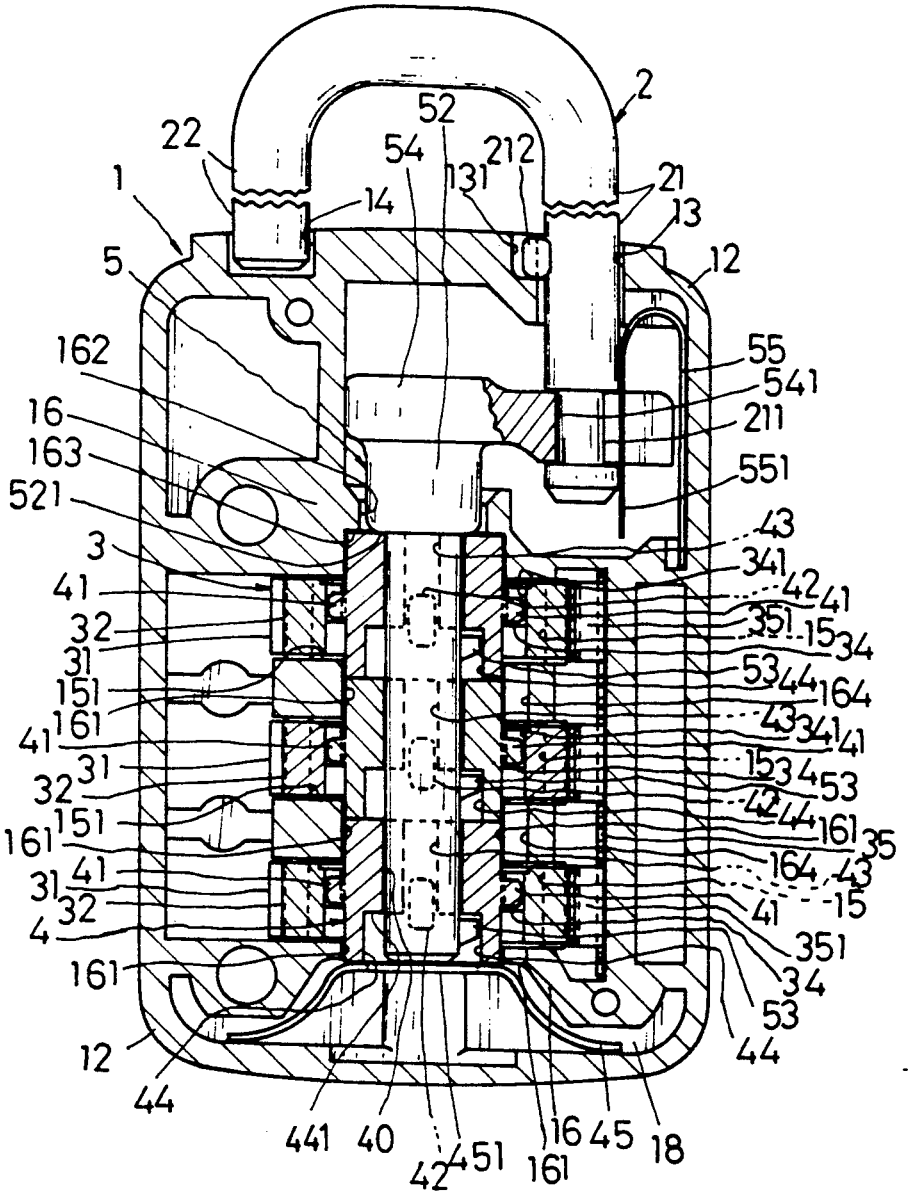
FIG. 4 is a sectional drawing of the present invention when locked.
Figure 6:
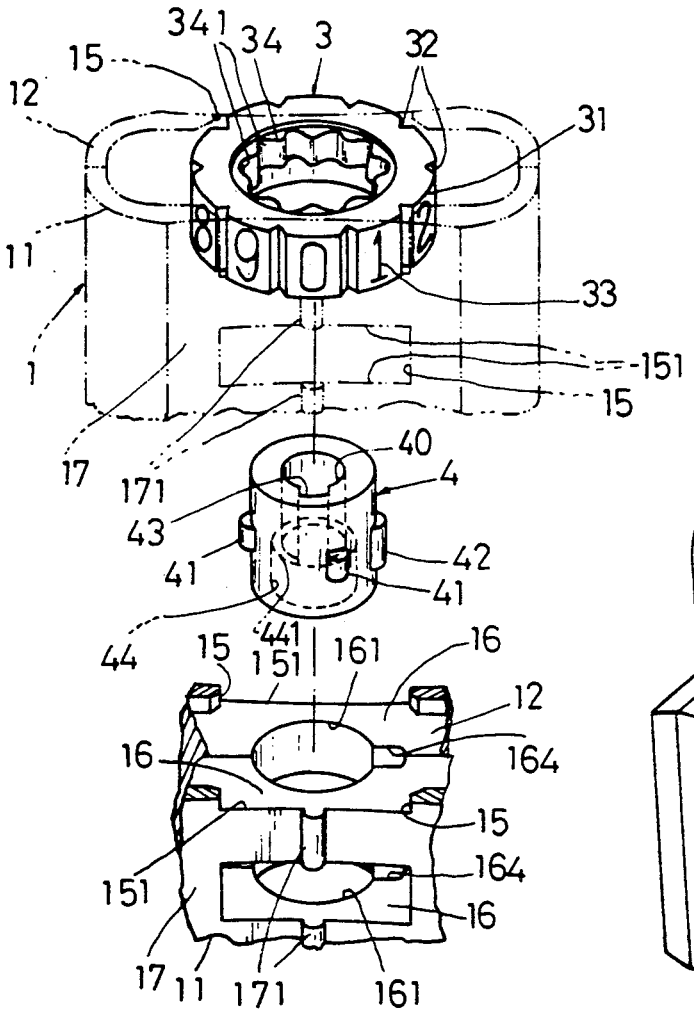
FIG. 6 is a partial perspective view of the present invention.
Figure 7:
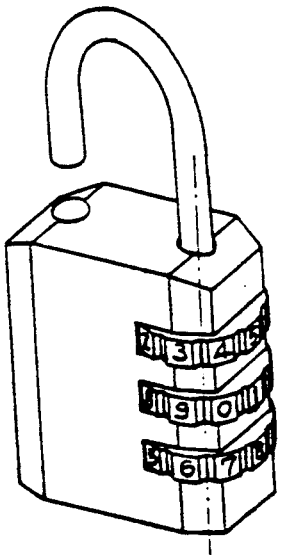
PRIOR ART FIG. 7
FIG. 7 shows a prior art of a conventional combination padlock.

A bolt shoulder portion 521 is formed between the head portion 52 and the locking bolt 51 for operatively depressing the sleeves 4 as shown in FIG. 5 when changing a combination of the present invention.

When using the present invention for locking purpose, the dials 3 are rotated to be deviated from its opening or unlocking combination to also rotate the sleeves 4 to disengage the opening slot 43 in each sleeve 4 from the bolt projection 53 so that upon an upward pulling of the shackle 2 trying to open the lock, the locking bolt 51 as connected with the shackle 2 by the lever 54 will also be pulled upwardly and the bolt projections 53 on the bolt 51 will be retarded by the lower shoulder portion 441 of each sleeve, thereby preventing the upward pulling of the locking bolt 51 and the shackle 2 to lock the shackle 2 on the casing 1.

For unlocking the present invention, the dials 3 are rotated to an opening combination to align the projections 53 on the bolt 51 with the slots 43 in the sleeves 4 so that upon an upward pulling of the shackle 2, the bolt 51 will not be obstructed by the sleeves 4 and will be raised along with the upward withdrawing of the shackle 2 until the short leg member 22 leaves from the socket 14. By rotating the shackle 2 about the long leg member 21 pivotally secured in the shackle hole 13 in the casing 1, the short leg member 22 will be swung sidewardly for unlocking the padlock.

For locking the present invention, the short leg member 22 is returned to be inserted into the shackle socket 22 and the long leg member 21 is depressed downwardly to allow its shackle projection 212 to engage the first projection slot 131 formed in the casing 1 and the bolt projections 53 of the locking bolt 51 are locked by the sleeves 4 by rotating the dials 3.

When the padlock is unlocked, the shackle 2 is rotated and then depressed downwardly to allow the shackle projection 212 to engage the second projection slot 132 formed in the casing 1 as shown in FIG. 5 to allow the positioning tooth 42 of each sleeve 4 to engage the positioning slot 164 formed in the bush extension 16 of the casing 1 for stabilizing the sleeve 4 and to disengage the outer teeth 41 of the sleeve 4 from the inner teeth 341 of each dial 3, allowing a free rotation of any dial 3 for resetting a new combination for changing the combination as previously set. Then, the shackle 2 is pulled upwardly to reengage the sleeve 4 with the dials 3 to finish the combination-changing operation.

The present invention may be modified without departing from the spirit and scope of this invention.

I claim:

1. A combination padlock comprising:

a casing comprised of two half-shell portions combinable for forming said casing having two wide-surface side portions respectively disposed on a front and a rear side portion of said casing; a shackle generally U shaped having a long leg member pivotally secured in a shackle hole formed in a right side portion of said casing and a short leg member operatively engaged in a shackle socket formed in a left side portion of said casing, said long leg member of the shackle formed with a neck portion annularly recessed from a cross section of a lower portion of the long leg member, a shackle head portion formed on a lowest end portion of the long leg member adjacent to the neck portion, and a shackle projection longitudinally formed in the long leg member engageable with a first projection socket recessed in a first upper portion of the casing communicated with the shackle hole when the short leg member is locked in the shackle socket, and rotatably engageable with a second projection socket recessed in a second upper portion of the casing deviated from the first projection socket;

a plurality of dials longitudinally rotatably mounted in a central portion of said casing along a longitudinal axis formed in a center of said casing having each said dial transversely protruding frontwardly and rearwardly from the two wide-surface front and rear side portions to form two secant dial peripheries disposed on said two front and rear side portions of said casing; a plurality of sleeves each said sleeve rotatably engageable with each said dial and rotatably secured in said casing; and a locking bolt means normally engageable with said sleeves for locking purpose and operatively disengaged from said sleeves for unlocking purpose, said locking bolt means including: a locking bolt generally cylindrical shaped engageable with a central bolt hole formed in each said sleeve, a head portion formed on an upper portion of the locking bolt secured with a connecting lever rotatably coupled with the long leg member of the shackle, a plurality of bolt projections longitudinally formed on the locking bolt, each said bolt projection normally retained under a lower shoulder portion of each said sleeve when the padlock is locked, and operatively passing through each opening slot formed in each said sleeve when the padlock is unlocked and a shackle retaining spring retained in the casing normally urging the long leg member of the shackle for coupling the connecting lever of the locking bolt means with said shackle, said connecting lever protruded sidewardly to form a bifurcated shackle retainer defining a notch recessed in the shackle retainer for rotatably engaging the shackle head portion with the shackle retainer and engaging the neck portion of the shackle with the notch of the connecting lever, the shackle head portion resiliently urged by a free spring end of the shackle retaining spring for a stable coupling of the shackle with the locking bolt means.

2. A combination padlock according to claim 1, wherein each said half-shell portion of said casing includes: a plurality of rectangular windows formed in each said half-shell portion for protruding each said dial therethrough, and a plurality of half bush extensions protruding upwardly from each said half-shell portion, each said half bush extension being juxtapositonal to each said window and every two said half bush extensions combinably defining a sleeve bush in the two corresponding half bush extensions for rotatably mounting each said sleeve therein.

3. A combination padlock according to claim 2, wherein each said half-shell portion is formed with a shallow arcuate recess in an outer surface of said half-shell portion for protruding each said dial having a marking extension longitudinally formed in a central portion of the half-shell portion for indicating a correct opening combination of the dials.

4. A combination padlock according to claim 2, wherein an uppermost bush extension of said half bush extensions is formed a bush shoulder portion for limiting an uppermost sleeve, and an upper bolt hole formed in said bush shoulder portion for passing said locking bolt means therethrough.

5. A combination padlock according to claim 2, wherein a plurality of positioning slots are longitudinally projectively formed in the plurality of sleeve bushes formed in the casing.

6. A combination padlock according to claim 1, wherein each said dial is rotatably secured in the casing along the longitudinal axis formed in the center portion of the casing and transversely protruding frontwardly and rearwardly through two corresponding rectangular windows formed in a front side portion and a rear side portion of the casing and includes an outer ring having a plurality of numerals annularly formed in the outer ring with every two neighbouring numerals separated by a longitudinal groove notched in the outer ring, an inner ring formed on an upper portion of the dial inside the outer ring having a plurality of inner teeth annularly formed in the inner ring, and a dial-sensing spring plate retained in the casing having a plurality of spring pawls longitudinally formed in the dial-sensing spring plate for clickingly engaging the grooves of the dial.

7. A combination padlock according to claim 1, wherein each said sleeve is formed as a cylindrical collar rotatably engageable with each said sleeve bush formed in said casing and includes: a central bolt hole formed through the sleeve, a plurality of outer teeth circumferentially formed on an outer cylindrical surface of the sleeve and engageable with the inner teeth of the dials, a positioning tooth formed on the outer cylindrical surface of the sleeve engageable with the inner teeth of the dial and slidably engageable with the positioning slot formed in the casing, an opening slot longitudinally recessed in the central bolt hole, and a lower enlarged hole diverging downwardly from the central bolt hole to form a lower shoulder portion between the bolt hole and the enlarged hole.

8. A combination padlock according to claim 7, wherein a sleeve retaining spring is formed near a bottom portion of the casing having an upper retaining surface for normally urging the sleeves upwardly to be limited by the bush shoulder portion for engaging each said sleeve with each said dial.

9. A combination padlock according to claim 1, wherein a bolt shoulder portion is formed between the head portion of said locking bolt and the locking bolt for operatively depressing the sleeves for changing a combination of the padlock.

* * * * *